US011933284B2

(12) United States Patent
Schofield et al.

(10) Patent No.: US 11,933,284 B2
(45) Date of Patent: Mar. 19, 2024

(54) MULTIPLE CHAMBER VACUUM EXHAUST SYSTEM

(71) Applicant: Edwards Limited, Burgess Hill (GB)

(72) Inventors: Nigel Paul Schofield, Burgess Hill (GB); Christopher Mark Bailey, Burgess Hill (GB); Michael Andrew Galtry, Burgess Hill (GB); Andrew David Mann, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 420 days.

(21) Appl. No.: 17/297,807

(22) PCT Filed: Nov. 27, 2019

(86) PCT No.: PCT/GB2019/053352
§ 371 (c)(1),
(2) Date: May 27, 2021

(87) PCT Pub. No.: WO2020/109790
PCT Pub. Date: Jun. 4, 2020

(65) Prior Publication Data

US 2022/0010788 A1 Jan. 13, 2022

(30) Foreign Application Priority Data

Nov. 28, 2018 (GB) ..... 1819351

(51) Int. Cl.
*F04B 37/14* (2006.01)
*F04B 41/06* (2006.01)
(Continued)

(52) U.S. Cl.
CPC ..... *F04B 37/14* (2013.01); *F04B 41/06* (2013.01); *F04B 49/007* (2013.01); *F04D 13/12* (2013.01);
(Continued)

(58) Field of Classification Search
CPC ..... F04B 37/14; F04B 41/06; F04B 49/007; F04B 49/06; F04D 19/042; F04D 25/16; F04D 27/005; F04D 13/12
See application file for complete search history.

(56) References Cited

U.S. PATENT DOCUMENTS 4,850,806 A * 7/1989 Morgan ..... F04B 37/14 417/205
5,228,838 A * 7/1993 Gebele ..... B01J 3/006 417/250
(Continued)

FOREIGN PATENT DOCUMENTS

CN 2767710 Y 3/2006
CN 101922437 A1 12/2010
(Continued)

OTHER PUBLICATIONS

Taiwanese Office Action dated Jun. 6, 2023 for corresponding Taiwanese application Serial No. 108143324, 15 pages.
(Continued)

*Primary Examiner* — Dominick L Plakkoottam
(74) *Attorney, Agent, or Firm* — Westman, Champlin & Koehler, P.A.

(57) ABSTRACT

A vacuum exhaust system includes a plurality of turbo pumps that evacuate a plurality of vacuum chambers. A plurality of chamber valves are positioned between the turbo pumps and the plurality of vacuum chambers. A plurality of branch channels are each connected to a corresponding exhaust of the plurality of turbo pumps and a main channel is formed from a confluence of the branch channels. A booster vacuum pump is connected to the main channel. A backing vacuum pump is connected to an exhaust of the booster vacuum pump. A plurality of bypass channels, each having a valve, provide a fluid communication path between
(Continued)

at least some of the plurality of vacuum chambers and the booster vacuum pump.

15 Claims, 2 Drawing Sheets

(51) Int. Cl.

| | |
|---|---|
| ***F04B 49/00*** | (2006.01) |
| ***F04D 13/12*** | (2006.01) |
| ***F04D 19/04*** | (2006.01) |
| ***F04D 25/16*** | (2006.01) |
| ***F04D 27/00*** | (2006.01) |

(52) U.S. Cl.
CPC ..... *F04D 19/042* (2013.01); *F04D 25/16* (2013.01); *F04D 27/005* (2013.01)

(56) References Cited

U.S. PATENT DOCUMENTS

| | | | | |
|---|---|---|---|---|
| 5,254,169 | A * | 10/1993 | Wenk | C23C 14/562 118/733 |
| 5,575,859 | A | 11/1996 | Arami et al. | |
| 6,004,109 | A | 12/1999 | Gebele et al. | |
| 6,736,606 | B1 * | 5/2004 | Ohmi | F04D 25/00 417/244 |
| 6,817,377 | B1 * | 11/2004 | Reimer | F04D 27/0261 137/565.33 |
| 7,927,482 | B1 * | 4/2011 | Luke | A61C 19/00 210/241 |
| 11,437,248 | B2 * | 9/2022 | Seeley | F04C 25/02 |
| 2005/0142010 | A1 * | 6/2005 | Bailey | F04D 25/00 417/423.4 |
| 2005/0147509 | A1 * | 7/2005 | Bailey | H01L 21/67017 417/423.4 |
| 2005/0196254 | A1 * | 9/2005 | Kim | H01L 21/67173 414/217 |
| 2006/0118178 | A1 | 6/2006 | Desbiolles et al. | |
| 2010/0206407 | A1 * | 8/2010 | Gawer | C23C 14/566 137/565.29 |
| 2015/0267296 | A1 * | 9/2015 | Nishida | H01L 21/0214 118/704 |
| 2015/0377226 | A1 | 12/2015 | Stones et al. | |
| 2017/0200622 | A1 * | 7/2017 | Shiokawa | C23C 16/52 |
| 2019/0131120 | A1 * | 5/2019 | Yamaguchi | H01L 21/022 |

FOREIGN PATENT DOCUMENTS

| | | | | |
|---|---|---|---|---|
| EP | 0510656 | A2 | 10/1992 | |
| EP | 0541989 | A1 | 5/1993 | |
| FR | 2998010 | A1 | 5/2014 | |
| TW | 201604315 | A | 2/2016 | |
| WO | 2011121322 | A2 | 10/2011 | |
| WO | 2012059679 | A1 | 5/2012 | |
| WO | 2014072452 | A1 | 5/2014 | |
| WO | 2016110695 | A1 | 7/2016 | |
| WO | WO-2016110694 | A1 * | 7/2016 | C23C 16/4405 |

OTHER PUBLICATIONS

Japanese Notification of Reason for Rejection dated Jul. 31, 2023 for corresponding Japanese application Serial No. JP2021-530818, 11 pages.

British Examination Report dated Jun. 7, 2019 and Search Report dated Jun. 6, 2019 for corresponding British Application No. GB1819351.6, 7 pages.

PCT Notification of Transmittal of the International Search Report and the Written Opinion of the International Searching Authority, or the Declaration dated Jan. 31, 2020, PCT Search Report and Written Opinion dated Jan. 31, 2020 for corresponding PCT Application No. PCT/GB2019/053352.

PCT Written Opinion dated Jan. 31, 2020 for corresponding PCT Application No. PCT/GB2019/053352.

Chinese First Office Action dated Jun. 15, 2022 for corresponding Chinese application Serial No. 201980078994.X, 22 pages.

* cited by examiner

MULTIPLE CHAMBER VACUUM EXHAUST SYSTEM

CROSS-REFERENCE OF RELATED APPLICATION

This application is a Section 371 National Stage Application of International Application No. PCT/GB2019/053352, filed Nov. 27, 2019, and published as WO 2020/109790A1 on Jun. 4, 2020, the content of which is hereby incorporated by reference in its entirety and which claims priority of British Application No. 1819351.6, filed Nov. 28, 2018.

FIELD

The field of the invention relates to a vacuum exhaust system which exhausts gas from multiple chambers such as process chambers used in semiconductor fabrication.

BACKGROUND

Semiconductor fabrication plants have multiple vacuum chambers located in a clean room to reduce the chance of contamination. They require a low stable pressure to be maintained within each chamber. This is conventionally done by a vacuum exhaust system comprising a turbomolecular pump attached to the vacuum chamber with a booster and a backing pump attached to the turbo pump's exhaust. The backing pump and booster pump may be located outside of the clean room in the subfab to reduce contamination and vibrations within the clean room.

The semiconductor processes within each chamber are asynchronous, cyclic and intermittent with the type and amount of gas being evacuated varying over time. The gas produced by the reaction with the process gas (the reaction product gas) and the residuum of the process gas are exhausted to the exterior of the chamber by the vacuum exhaust system.

Thus, the exhaust system for such chambers should be able to evacuate different and varying amounts of gases and generate and maintain a stable high vacuum.

It would be desirable to share pumps across multiple semiconductor processing chambers to reduce the overheads associated with the multiple pumps while still providing a stable high vacuum within each chamber.

The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides a vacuum exhaust system for evacuating a plurality of vacuum chambers. The vacuum exhaust system comprises: a plurality of low pressure vacuum pumps configured to operate in the molecular flow region of the gas and configured for evacuating said plurality of vacuum chambers. The vacuum exhaust system comprises a plurality of chamber valves for isolating or connecting said plurality of low pressure vacuum pumps with said plurality of vacuum chambers; a plurality of branch channels each connected to a corresponding exhaust of said plurality of low pressure vacuum pumps; a main channel formed from a confluence of said branch channels and configured to provide a fluid communication path between said plurality of branch channels and an intermediate pressure vacuum pump, said intermediate pressure vacuum pump being configured to evacuate said main channel and to operate in a viscous flow region of said gas; and a higher pressure vacuum pump configured to operate in a higher pressure viscous flow region of said gas than said intermediate pressure vacuum pump said higher pressure vacuum pump being connected to an exhaust of said intermediate pressure vacuum pump; a plurality of bypass channels for providing a fluid communication path between at least some of said plurality of vacuum chambers and a higher pressure vacuum pump; wherein said plurality of bypass channels each comprises a valve configured to open or close said bypass channel.

It is recognised that the number of pumps required to evacuate a multiple vacuum chamber system could be reduced if multiple chambers and low pressure vacuum pumps were backed by a set of shared booster (intermediate pressure vacuum) pump and backing (higher pressure vacuum) pumps. However, owing to the intermittent and asynchronous nature of the processes within each chamber, pressure spikes at the exhausts of one of the low pressure vacuum pumps due to changes in the process within the chamber may affect the pressure at the exhaust of the low pressure pump of the other chambers where the exhausts are combined in a shared channel leading to a shared booster pump. This could lead to instabilities in the vacuum within the chambers. This is a particular problem where a chamber is added to the system or has been vented for some reason and is to be pumped down from atmosphere.

These problems have been mitigated by embodiments with the provision of a bypass channel that bypasses both the high vacuum (low pressure) and the intermediate pressure vacuum pumps and allows the chamber to be connected directly to a higher pressure vacuum pump. In this regard it is known to bypass the low pressure vacuum pump when a chamber is vented as the low pressure vacuum pump operates in the molecular flow region and cannot operate at higher pressures. However, conventionally a bypass channel to the booster or intermediate pressure viscous flow pump is used. Where such a pump is shared between chambers, then pumping a chamber at atmospheric pressure using this pump will lead to significant spikes in the pressure in the shared channel leading to the pump which will be felt at the exhausts of the low pressure pumps to the multiple chamber and may lead to instabilities in the pressure within these chambers. In order to address this, embodiments provide a bypass channel that diverts the gas flow to the higher pressure vacuum pump. The gas flow entering the higher pressure pump is at a higher pressure than that entering the intermediate pressure pump, so any pressure spike is smaller, furthermore, the main channel is protected from this pressure spike by the presence of the intermediate pressure pump.

In some embodiments, said higher pressure vacuum pump connected to said exhaust of said intermediate pressure vacuum pump and said higher pressure vacuum pump in fluid communication with said plurality of bypass channels is a same higher pressure vacuum pump.

In other embodiments, said higher pressure vacuum pump connected to said exhaust of said intermediate pressure vacuum pump and said higher pressure vacuum pump in fluid communication with said plurality of bypass channels are different higher pressure vacuum pumps.

The rough pumping of the vacuum chambers done by the higher pressure vacuum pump allows these chambers to be pumped down from atmosphere to an intermediate pressure without the gas flow flowing via the main shared channel and therefore affecting the pressure at the output of the low pressure pumps. In some cases the higher pressure vacuum pump that is used for this process is the same higher pressure vacuum pump that is used as a backing pump to the intermediate pressure vacuum pump. This provides for an efficient system that only requires one higher pressure vacuum pump to be in operation at any one time and allows it to be continuously run. In other embodiments, a separate higher pressure vacuum pump may be used and this reduces the changes in pressure felt by the shared system but increases the overhead and requires a separate pump to be operational.

In some embodiments, the vacuum exhaust system comprises, a main bypass channel formed from a confluence of said plurality of bypass channels, said main bypass channel and said plurality of bypass channels providing said fluid communication path between said plurality of vacuum chambers and said higher pressure pump.

As the bypass channels are directed to a same higher pressure pump the channels may be merged to form a main shared bypass channel which then leads to this shared pump.

In some embodiments, said bypass channels have a smaller diameter than said branch channels.

As the bypass channels are used for the pumping of the vacuum chambers when they are at a higher pressure the diameters of the pipes may be smaller than the diameter of the pipes of the channels which are used for pumping lower pressure gasses. In this regard both the bypass channels and the main bypass channel have a smaller diameter than the branch channels and the main channel respectively. The bypass channels may be ten or more times smaller than the branch channels in some embodiments, while in others they may be five or more times smaller. This allows the bypass channels to be manufactured and formed in a cost effective manner.

In some embodiments, said branch channels and main channel comprise heating circuitry for heating said channels to reduce condensation of substances being pumped.

As the branch channel and main channels are used for the flow of process gasses it may be advantageous to heat these channels to avoid the chemicals in the process gasses condensing as the pressure in the channels increases as the gas flows through the system. The gases evacuated via the bypass channel are however, not process gases but gases present after the chamber has been vented. Thus, the requirements for heating these channels are not the same as for the branch channels and heaters can be dispensed with which again reduces the cost of such bypass channels.

In some embodiments, the vacuum exhaust system further comprises, a further plurality of channels for providing a fluid communication path between said plurality of bypass channels and said plurality of branch channels, said further plurality of channels each comprising a valve for opening or closing said further plurality of channels.

It may be advantageous to have a channel connecting each bypass channel to a corresponding branch channel. In this regard, the bypass channel is used for evacuating the vacuum chamber from atmosphere by the higher pressure vacuum pump. When the vacuum chamber has been pumped down to a pressure of operation of this pump then the valve in the bypass channel may be closed and the valve in the channel connecting the bypass channel to the branch channel may be opened and this will connect the vacuum chamber to the shared main channel which is being evacuated by the intermediate vacuum pump backed by the higher pressure vacuum pump. At this point, the shared main channel may see a small pressure spike as the vacuum chamber will still be at a higher pressure than its usual pressure of operation. However, it will be at a significantly lower pressure than atmospheric pressure and thus, the pressure spike will be small. In this regard, the higher pressure pump may pump down to 10 mbar while the intermediate vacuum pump may pump down to 1 mbar. Thus, the main channel may receive gas at a pressure of 10 mbar when the valve in the connecting channel is opened but it does not receive gas at atmospheric pressure following venting of a chamber.

In some embodiments, at least some of said plurality of branch channels comprise a controllable inlet for admitting Nitrogen, or some other purge gas.

As noted previously, it is important to try to avoid or at least reduce pressure fluctuations in the main channel as this main channel receives exhaust gas from many different vacuum chambers and pressure fluctuations will affect the operation of the low pressure vacuum pumps connected to these chambers. However, the processes performed within these chambers are asynchronous such that different processes are performed at different times and thus, the rate of flow of gas output from the chambers and flowing down the different branch channels will vary over time. This leads to pressure fluctuations in the main channel and to undesirable pressure spikes. One way of reducing these variations is to use a gas inlet for admitting a controllable flow of gas such as nitrogen into the branch channel the flow being controlled to compensate for the variations.

In some embodiments, the vacuum exhaust system comprises inlet control circuitry configured to control said controllable inlet to admit a controlled amount of gas in dependence upon a gas flow in said branch channel, such that variations in said gas flow output by said branch channel are reduced.

By careful control of the input of Nitrogen the changes in flow rate in the branch channel due to the changes in the process chamber can be compensated for and fluctuations in the gas flow output by the branch channel to the main channel can be reduced.

This control can be done in a number of ways, in some embodiments said control circuitry is configured to monitor a power consumption of said low pressure pump evacuating said vacuum chamber and to control said controllable inlet in dependence upon said power consumption.

In other embodiments, said control circuitry is configured to receive signals from said vacuum chamber indicative of a current process in said vacuum chamber and to control said controllable inlet in dependence upon said signals.

The power consumption of the low pressure pump will depend on the flow rate of gas that is being pumped and thus, this can be used as an indication of the flow rate and can be used to change the amount of Nitrogen input to compensate for changes in the flow rate. Alternatively, a controlled signal from the vacuum chamber indicative of the current process could be used as an input indicative of flow rate to adjust the input of gas.

In some embodiments, the vacuum exhaust system further comprises a pressure sensor for monitoring a pressure within said main channel; and pressure control circuitry configured to receive signals from said pressure sensor and generate control signals for reducing fluctuations in said pressure.

A still further way of maintaining a more constant pressure within the main channel and reducing pressure fluctuations that may be felt at the exhaust of the low pressure pumps is with the use of a pressure sensor that monitors a pressure within the main channel and pressure control circuitry that receives signals from this pressure sensor and generates control signal to reduce the fluctuations. These control signals may control a flow restrictor in the main channel or they may control the pumping speed of the backing pump for example. Alternatively and/or additionally, the pressure control circuitry is configured to generate control signals for controlling a pumping speed of said intermediate vacuum pump in dependence upon an output of said pressure sensor.

In other embodiments the vacuum exhaust system further comprises a controllable gas inlet for admitting a controlled amount of gas into said main channel, said pressure control circuitry being configured to generate control signals for controlling said controllable gas inlet. In some embodiments the gas is Nitrogen.

In some embodiments, said branch channels comprise controlled restrictors, a restriction of said restrictors being set to provide a predetermined pressure at a predetermined flow rate at an exhaust of said lower pressure vacuum pump.

In some embodiments, in order to try to compensate for differences in pressure felt at the exhausts of the low pressure pumps, due to their distance from the shared pumps adjustable restrictors in the branch channels connected to the low pressure pumps are used. These are set to a certain restriction in an initial phase, this restriction being selected to provide a predetermined pressure at a predetermined flow rate.

Although there may only be a single intermediate pressure vacuum pump and a single higher pressure vacuum pump, in some embodiments, the vacuum exhaust system comprises a plurality of intermediate pressure vacuum pumps arranged in series with each other.

Pressure spikes in the main channel are reduced by using a bypass channel to route gas from the vacuum chambers, where they have been vented and are at higher pressures, to the higher pressure pump, bypassing both the low pressure and intermediate pressure pumps. The presence of the intermediate pump between the main channel and the bypass channel outlet provides a buffer to the increased pressure felt by the pumping of this higher pressure gas and helps reduce any pressure spike in the main channel Where there are multiple, in some embodiments two, intermediate pressure pumps located between the bypass channel outlet and the main channel, then this protection from the pressure spike is improved and pumping down of chambers vented to atmosphere can be achieved with very little effect on the pressure in the other chambers.

In some embodiments, the vacuum exhaust system further comprises valve control circuitry, said valve control circuitry being configured to control a state of said valves, said valve control circuitry being configured to ensure that for each of said plurality of vacuum chambers and associated exhaust channels, said chamber valves and said valves in said different exhaust channels are not open at a same time.

Valve control circuitry can be used to control the valves during operation. The valve control circuitry should ensure that when a chamber valve for a chamber is open then valves in the bypass channel and the channel connecting the bypass channel to the branch channel should be closed. Furthermore, if the bypass channel valve is open, then the valve in the channel connecting the bypass channel to the branch channel should be closed as should the valve in the chamber. This ensures that the gasses are pumped via one of the routes to particular pumps and not via multiple routes to different pumps all operating together. Thus, the gases may be pumped by the low pressure pump where the chamber valve is opened and the bypass channel is not used. Where the bypass channel valve is open then the chamber has a connection to the higher pressure vacuum pump and neither the low pressure pump or the intermediate pressure pump should be connected to the chamber.

In some embodiments, said valve control circuitry is configured to control evacuation of said chambers, said valve control circuitry being configured: in response to a signal indicating a vacuum chamber is to be vented to atmosphere, to close said corresponding chamber valve and isolate said chamber from said main channel; and in response to a signal indicating said vacuum chamber is to be pumped down from atmosphere to open said valve in said bypass channel such that said chamber is in fluid communication with said higher pressure vacuum pump.

Control of the valves can control isolation of the chamber during venting and then allow pumping down from atmosphere in a way that reduces the impact of pressure fluctuations on the shared main channel.

In some embodiments, said valve control circuitry is further configured:

In response to said vacuum chamber being evacuated to a predetermined intermediate pressure to send control signals to close said bypass channel valve and to open said valve in a corresponding one of said further plurality of channels such that said vacuum chamber is in fluid communication with said intermediate vacuum pump; and in response to said vacuum chamber reaching a lower pressure to send control signals to close said valve in said corresponding one of further plurality of channels and open said valve in said vacuum chamber.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Figure 1:
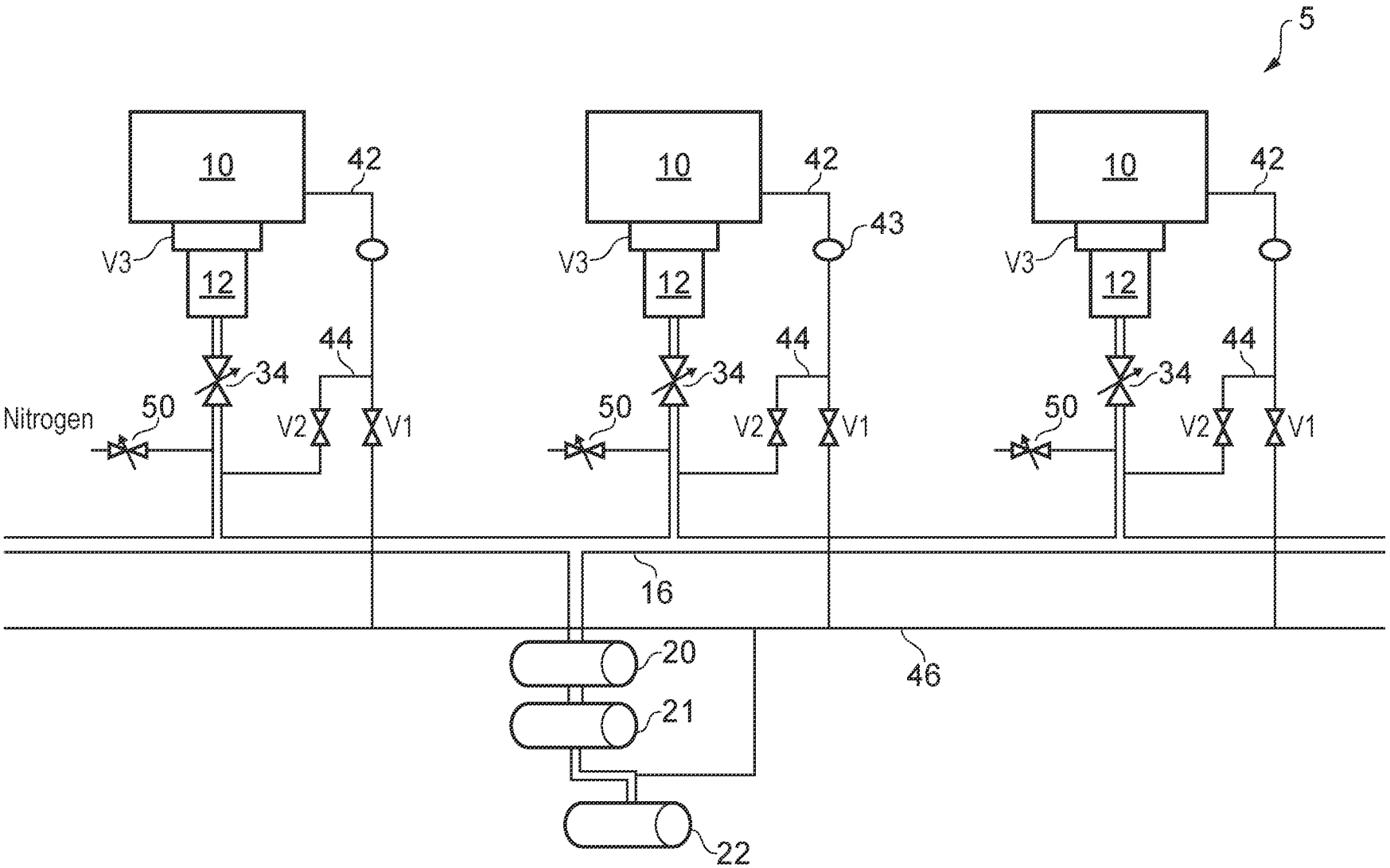
FIG. 1 illustrates a vacuum exhaust system according to an embodiment.

Before discussing the embodiments in any more detail, first an overview will be provided.

Embodiments relate to a system that shares a common process pump across multiple semiconductor processing chambers and achieves a stable pressure in each processing chamber.

The chambers in the system may all be controlled independently and therefore are on total asynchronous process cycles. In one example the number of process chambers is 24—there being 6 per tool and 4 tools, all sharing a single backing pump feeding a single abatement unit.

The process chemistry of every part of the cycle is compatible with every other part of the cycle.

There may be redundancy provided to allow the system to continue if a pump or abatement unit fails, allowing it to be repaired or maintained without shutting down all 24 chambers. Thus, although the system may operate with a single set of booster and backing pumps, there may be a spare set of booster and backing pumps which are brought into operation when the other pumps become non-operational.

In embodiments, the backing pump combination is located in the subfab and comprises a backing pump and a booster and each process chamber is located in the cleanroom—typically 10-20 meters above the subfab.

In embodiments, each process chamber is fitted with a turbo pump and each turbo pump has a bypass line to allow for pump down from atmospheric pressure.

Conventionally each turbo pump is backed by its own backing pump and booster pump combination located in the subfab. In the proposed shared system of an embodiment, each turbo pump exhaust port is connected to a common manifold which is pumped by a much larger, common shared backing pump and booster combination located in the sub fab.

The objective of embodiments is to allow the process chambers to operate independently and with minimal or at least reduced interference between the chambers whilst sharing common vacuum and abatement equipment.

In one embodiment pumping down occurs via a bypass line that is connected to the backing pump. Pumping down via a turbo bypass line and restrictor is known. Conventionally the bypass line is connected to the booster or intermediate pressure pump. However, with a shared booster pump, if the chamber is connected directly to the manifold (main channel)—opening the bypass valve to pump down the chamber will produce a momentary high flow of gas into the manifold and will cause a pressure spike. This results in a pressure spike in each of the connected chambers. These are likely to be processing wafers and such a pressure spike could disrupt the process.

Embodiments connect the bypass line and restrictor to a secondary manifold system (shared bypass channel) that connects to the backing pump inlet in the subfab—between the booster exhaust and the backing pump. Alternatively it may connect to a completely separate backing pump. This can be done using small diameter pipe. Furthermore, it will not see process gas so does not need to be heated. This secondary manifold operates at a higher pressure than the main process manifold and therefore is less affected by the pressure spike. Additionally, the booster pump helps to isolate the pressure spike in the secondary manifold from the process manifold. Once the chamber has been pumped down to that of the secondary manifold, typically 10 mbar, then the valve V1 (see FIG. 1) can be closed and V2 is opened allowing the chamber to be pumped down by the main process manifold, typically at 1 mbar. This final pumping stage has a very small gas flow and so does not produce a significant pressure spike. Once this has been completed then the main turbo pump valve V3 can be opened as normal.

A further way to reduce crosstalk between chambers is to reduce any pressure fluctuations in the manifold.

Given that in some embodiments the manifold is pumped by a single pump running at constant speed, pressure fluctuations may be caused by changes in flow from one or more chambers. The flow from each chamber can vary due to the process being initiated or stopped or step changes during the process. In order to reduce the effect of these on the system, a nitrogen flow is added to each chamber backing line and is adjusted to keep the net flow in the line at a constant value. For example when the process is flowing maximum process gas then no additional gas flow is required, if however the process flow is reduced, or stopped, then the nitrogen flow is added to make up for the difference.

The process flow can be determined directly from the process tool itself or by monitoring the power consumption of the turbo pump.

In this system a single set of backing and booster pump combination is used to pump several chambers. If however the number of chambers is reduced due to maintenance, or product demand say, or simply some chambers not yet being installed, then the system needs to maintain substantially the same pressure in the process manifold. This can be achieved by monitoring the pressure with a pressure gauge and using this information to control the speed of the booster pump. Alternatively, a nitrogen flow can be added, either at the booster inlet or outlet.

FIG. 1 shows a vacuum exhaust system according to an embodiment. Vacuum exhaust system 5 is configured to exhaust gas from a plurality of processing chambers 10. These processing chambers are connected to low pressure turbo pumps 12 via valves V3. These turbo pumps exhaust via branch channels 14 to a main shared channel 16 which in turn leads to two booster or intermediate pressure pumps 20, 21 arranged in series. The booster or intermediate vacuum pumps are backed by a higher pressure or backing pump 22. During normal operation of the vacuum chambers the valve V3 is open and gas is evacuated from the vacuum chambers 10 via the turbomolecular pumps 12 along branch channel 14 through the shared main channel 16 to booster pumps 20, 21 and backing pump 22 where it is then exhausted.

Each branch channel has a flow restrictor 34 which is controllable to provide a uniform pressure output from the different vacuum chambers when they are operating in the same way. Thus, during a configuration or initialisation phase a standard gas flow is exhausted from the vacuum chamber via the turbo molecular pump 12 and the flow restrictor is set such that a pressure measured at the exhaust output of the turbo pump is a predetermined value. This helps compensate for differences in the pressure felt at the exhaust of the low pressure pumps due to differences in distance between these pumps and the shared booster pumps. In this regard where many chambers share one set of booster and backing pumps, then the distance between the low pressure pumps and the booster and backing pumps may vary considerably and thus, having a flow restrictor to compensate for these differences will provide a more uniform system.

Although having a main shared channel 16 and a single set of booster 20, 21 and backing 22 pumps leads to efficiency in hardware there are challenges with such a set up and in particular where many vacuum chambers that are operating asynchronously are connected to the shared channel 16 there will be variations in the pressure felt within this channel and these will affect the pressure at the exhaust of the turbomolecular pump and will in this way feed back to the pressure in the vacuum chambers 10. In order to reduce these pressure fluctuations there are various arrangements provided.

One of these comprises the bypass channel 42 which connects the vacuum chamber 10 with the backing pump 22. This bypass channel 42 has a valve V1 and when the pressure in the vacuum chamber 10 is high perhaps following it being vented to atmosphere and it is required to pump this chamber down to a lower pressure the valves V3 and V2 will be closed and the valve V1 opened and the higher pressure backing pump 22 will then be used to initially pump the chamber 10 down via the bypass channel 42 to a pressure of operation of the backing pump which in this embodiment is of the order of 10 mbars.

There may be a flow restrictor 43 on the bypass channel 42 to modify flow rates. Once the pressure in the vacuum chamber 10 reaches or nears the operational pressure of the backing pump 22 then valve V1 may be closed and valve V2 in a connecting channel 44 for connecting the bypass channel 42 to the branch channel 14 may be opened and at this point the vacuum chamber is connected to the booster pumps 20, 21. The booster pumps 20, 21 may then evacuate the chamber down to its operational pressure which is about 1 mbar. At this point the valve v2 may be closed and valve V3 may be opened and the turbomolecular pump can be used to produce the high vacuum for operation of the vacuum chamber.

Although, the vacuum chamber 10 is connected to the booster pumps 20, 21 via the shared channel 16 when the pressure in the vacuum chamber is above the standard pressure of operation, it is significantly lower than atmospheric pressure (in this example of the order of 1 mbar) and produces a much reduced pressure spike in the shared main channel 16. Furthermore, the presence of the two booster pumps 20, 21 between the shared bypass channel 46 outlet and the main channel 16 acts as a buffer to further reduce any pressure spike felt in the main channel 16.

As the bypass channels only operate at a relatively high pressure they may have a significantly smaller diameter than the branch channels and furthermore as they only pump gasses when the chamber has been vented and do not pump process gasses they will not require the heating required by the branch channels. Thus, providing these additional bypass channels is relatively cost effective.

It should be noted that each of the bypass channels 42 combine into a shared bypass channel 46 which then leads to backing pump 22 in this embodiment. In other embodiments there may be a separate backing pump (not shown) for pumping down the vacuum chambers from atmosphere. Where there is a separate backing pump for pumping the bypass channels, then generally only a single booster pump will be used in the main exhaust system, as the advantage of multiple booster pumps in series providing improved isolation between the outlet of the bypass channel and the main channel is no longer felt.

A further way in which reductions in variations in the pressure fluctuations in the main channel can be achieved is with the use of a gas input 50 in each of the branch channels. In this regard, the gas flow rate in the branch channels varies with the process variations in the process chambers 10. In order to compensate for these variations a gas inlet with a controllable restrictor or valve 50 may be used to admit a controlled amount of gas. The controlled amount is set to compensate for variations in the process flow such that a relatively constant gas flow is output to the shared channel 16. The gas admitted is generally one that is relatively non-reactive and acceptable to exhaust from the system, in this embodiment Nitrogen is used. The admission of the gas may be controlled in response to a signal from the chamber indicating the current process being performed or a signal from the turbomolecular pump indicating its current power consumption. In this regard, the power consumption of the turbomolecular pump will vary with flow rate and thus, the current power consumption is an indication of current flow rate.

Figure 2:
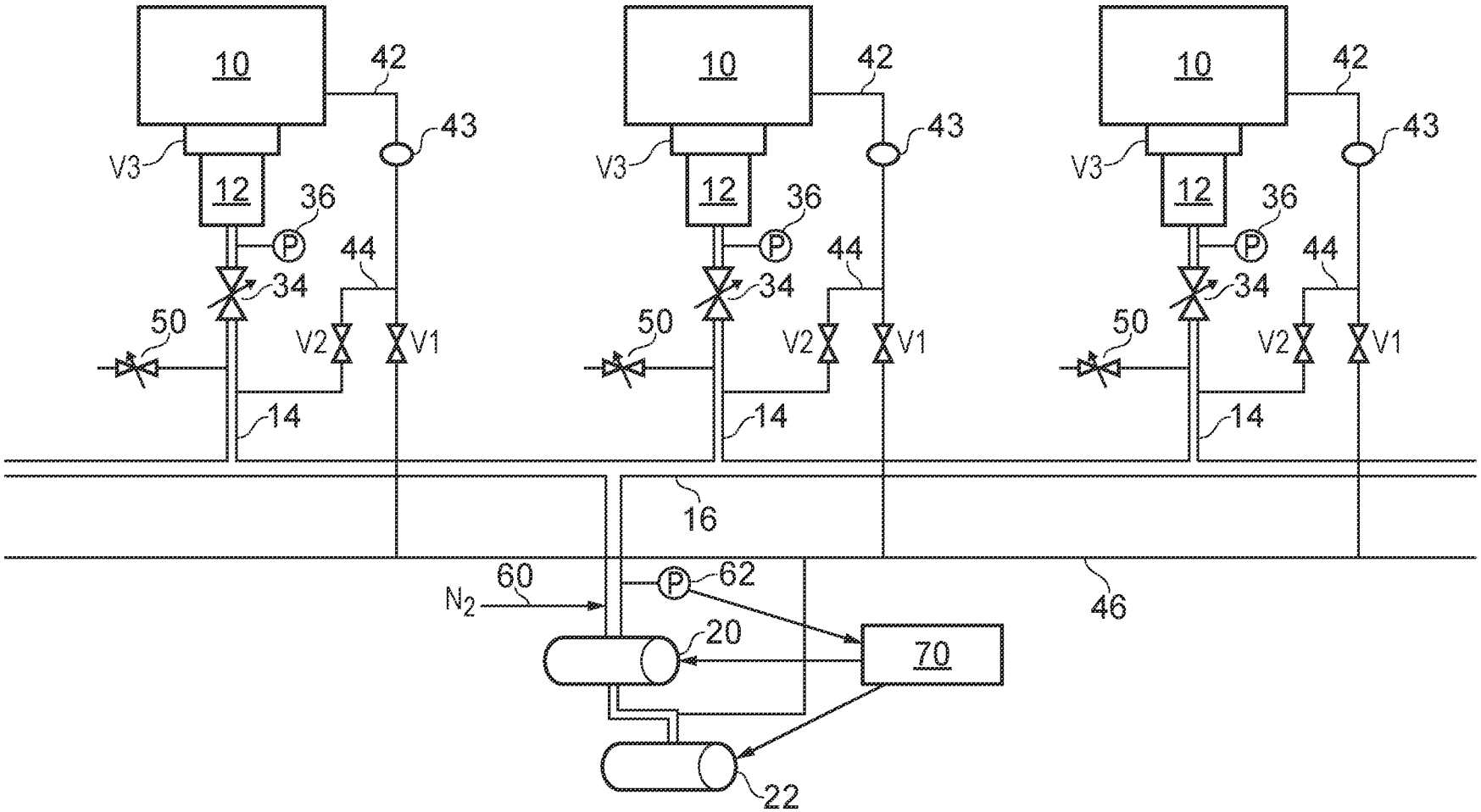
FIG. 2 illustrates a vacuum exhaust system according to a further embodiment.

FIG. 2 shows an exhaust system similar to that of FIG. 1, but with only a single booster pump 20. In this embodiment there are additional arrangements for reducing pressure fluctuations in the main channel 16. These comprise a gas inlet 60 for admitting gas, in this example Nitrogen to the shared channel 16. This inlet can be controlled by control circuitry 70 which receives signals from a pressure sensor 62 which measures the pressure in the shared channel 16. In this way the pressure within the shared channel can be actively maintained at a relatively constant value in response to readings from a pressure sensor 62.

Alternatively and/or additionally to the addition of a gas to the shared channel 16, the pressure may be controlled with a controllable flow restrictor (not shown) within the shared channel and/or with control of the speed of booster pump 20 and/or with the speed backing pump 22.

Control circuitry 70 is shown receiving signals from the pressure sensor and controlling the booster and backing pumps. The control circuitry may also control the valves V1, V2 and V3, the flow restrictor 34 and the variable inlet 50. It may receive signals from the process chambers, and/or from the turbomolecular pumps 12 indicating their power consumption and/or from pressure sensor 36. In this regard the branch channels 14 may have a pressure sensor 35 that is used to determine the pressure in the branch channel and may be used to set the restriction amount of flow restrictor 34 to provide a more uniform flow from the turbomolecular pump 12.

Embodiments seek to provide an exhaust system for pumping multiple chambers using a shared booster and backing pump where pressure fluctuations in the shared main channel which may lead to pressure variations in the vacuum chambers themselves are reduced. These pressure fluctuations may be reduced by the use of bypass channels to avoid higher pressure gasses from vented chambers flowing through the shared main channel and/or with gas inlets in the branch channels to compensate for the variations in flow output by the chambers and/or with use of controllable flow restrictors in the branch channels to maintain a uniform flow for each branch channel and/or with pressure sensors in the main channel and control circuitry for controlling pumping speeds and/or flow restrictors and/or gas inputs to maintain a stable pressure in the main channel.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A vacuum exhaust system for evacuating a plurality of vacuum chambers, said vacuum exhaust system comprising:

a plurality of turbo vacuum pumps configured for evacuating said plurality of vacuum chambers;

a plurality of chamber valves for isolating or connecting said plurality of turbo vacuum pumps with said plurality of vacuum chambers;

a plurality of branch channels each connected to a corresponding exhaust of said plurality of turbo vacuum pumps;

a main channel formed from a confluence of said branch channels and configured to provide a fluid communication path between said plurality of branch channels and a booster vacuum pump, said booster vacuum pump being configured to evacuate said main channel;

a backing vacuum pump connected to an exhaust of said booster vacuum pump;

a plurality of bypass channels for providing a fluid communication path between at least some of said plurality of vacuum chambers and the backing vacuum pump; wherein said plurality of bypass channels each comprise a backing valve configured to be switched between two states comprising a first state that prevents gas in the bypass channel from passing through the backing valve to reach the backing vacuum pump and a second state that allows gas in the bypass channel to pass through the backing valve to reach the backing vacuum pump; and a plurality of connecting valves, each connecting valve positioned between a respective bypass channel and the booster vacuum pump and configured to be switched between two states comprising a first state that prevents gas in the respective bypass channel from passing through the connecting valve to reach the booster vacuum pump and a second state that allows gas in the respective bypass channel to pass through the connecting valve to reach and be pumped by the booster vacuum pump.

2. The vacuum exhaust system according to claim 1, comprising a main bypass channel formed from a confluence of said plurality of bypass channels, said main bypass channel and said plurality of bypass channels providing said fluid communication path between said plurality of vacuum chambers and said backing vacuum pump.

3. The vacuum exhaust system according to claim 1, wherein said bypass channels have a smaller diameter than said branch channels.

4. The vacuum exhaust system according to claim 1, wherein said branch channels and main channel comprise heating circuitry for heating said branch channels and main channel to reduce condensation of substances being pumped.

5. The vacuum exhaust system according to claim 1, wherein at least one branch channel of said plurality of branch channels comprise a controllable inlet for admitting a gas.

6. The vacuum exhaust system according to claim 5, comprising inlet control circuitry configured to control said controllable inlet to admit a controlled amount of gas in dependence upon a gas flow in said at least one branch channel, such that variations in said gas flow output by said at least one branch channel are reduced.

7. The vacuum exhaust system according to claim 6, wherein said control circuitry is configured to monitor a power consumption of one turbo vacuum pump of said plurality of turbo vacuum pumps and to control said controllable inlet in dependence upon said power consumption.

8. The vacuum exhaust system according to claim 6, wherein said control circuitry is configured to receive signals from said vacuum chamber indicative of a current process in said vacuum chamber and to control said controllable inlet in dependence upon said signals.

9. The vacuum exhaust system according to claim 1, further comprising:

a pressure sensor for monitoring a pressure within said main channel; and pressure control circuitry configured to receive signals from said pressure sensor and generate control signals for reducing fluctuations in said pressure.

10. The vacuum exhaust system according to claim 9, said pressure control circuitry being configured to generate control signals for controlling a pumping speed of said booster vacuum pump in dependence upon an output of said pressure sensor.

11. The vacuum exhaust system according to claim 9 and further comprising a controllable gas inlet for admitting a controlled amount of gas into said main channel, said pressure control circuitry being configured to generate control signals for controlling said controllable gas inlet.

12. The vacuum exhaust system according to claim 1, wherein said booster vacuum pump comprises a plurality of booster vacuum pumps arranged in series with each other.

13. The vacuum exhaust system according to claim 1, wherein each branch channel of said branch channels comprise a respective controlled restrictor, a restriction of each said controlled restrictor being set to provide a predetermined pressure at a predetermined flow rate at an exhaust of said backing vacuum pump.

14. The vacuum exhaust system according to claim 1, and further comprising valve control circuitry, said valve control circuitry being configured to control a state of each chamber valve of said plurality of chamber valves, each said backing valve, and each connecting valve of said plurality of connecting valves, said valve control circuitry being configured to ensure that for a vacuum chamber of the said plurality of vacuum chambers, only one of a chamber valve associated with the vacuum chamber, a backing valve associated with the vacuum chamber and a connecting valve associated with the vacuum chamber is open at a same time.

15. The vacuum exhaust system according to claim 14, wherein said valve control circuitry is configured to control evacuation of the vacuum chamber of said plurality of vacuum chambers, said valve control circuitry being configured:

in response to a signal indicating the vacuum chamber is to be vented to atmosphere, to close the chamber valve associated with the vacuum chamber and isolate the vacuum chamber from said main channel; and in response to a signal indicating said vacuum chamber is to be pumped down from atmosphere to open the backing valve associated with the vacuum chamber such that said vacuum chamber is in fluid communication with said backing vacuum pump.

* * * * *